United States Patent [19]

Verjux

[11] 4,211,318

[45] Jul. 8, 1980

[54] PLATE WITH TILTED REVERSAL HEADS FOR A DEVICE FOR ORIENTATING CIGARETTES

[75] Inventor: Jean Verjux, Pavillons sous Bois, France

[73] Assignee: Arenco-Decoufle, Societe Anonyme, Paris, France

[21] Appl. No.: 12,113

[22] Filed: Feb. 14, 1979

Related U.S. Application Data

[63] Continuation of Ser. No. 838,477, Oct. 3, 1977, abandoned.

[30] Foreign Application Priority Data

Oct. 20, 1976 [FR] France ..... 76 31502

[51] Int. Cl.[2] ..... B65G 29/00; B65G 47/24

[52] U.S. Cl. ..... 198/377; 198/404; 198/951

[58] Field of Search ..... 198/377, 376, 378, 404, 198/931; 221/173; 198/412

[56] References Cited

U.S. PATENT DOCUMENTS

| | | | |
|---|---|---|---|
| 3,215,250 | 11/1965 | Schubert | 198/377 |
| 3,319,764 | 5/1967 | Gamberini | 198/377 |
| 3,485,337 | 12/1969 | Everhart | 198/951 X |

*Primary Examiner*—Robert B. Reeves
*Assistant Examiner*—Douglas D. Watts

[57] ABSTRACT

This rotary plate is of the type comprising reversal heads capable of rotating through half a revolution during a complete revolution of the plate in the opposite direction, with a view to taking up an object such as a filter-tipped cigarette and placing such an object or cigarette after having caused it to rotate through half a revolution.

Each of the reversal heads 13*a* effects, in relation to plate 13, no other movement but its rotation, axis *Za* of this rotation forming with rotational axis *Z* of plate 13 an angle α whose tangent is greater than the ratio d/Δ of the diameter d of the objects or cigarettes to be reversed to the distance Δ separating the rotational axes of two adjacent heads.

9 Claims, 8 Drawing Figures

PLATE WITH TILTED REVERSAL HEADS FOR A DEVICE FOR ORIENTATING CIGARETTES

This is a continuation of application Ser. No. 838,477, filed Oct. 3, 1977, now abandoned.

BACKGROUND OF THE INVENTION

Field of the Invention

The present invention relates to a rotary plate comprising reversal heads capable of rotating half a revolution about an axis fixed in relation to the plate whilst this latter rotates through a complete revolution in the reverse direction, in order to take, for example from a first channel portion of a drum rotating about an axis perpendicular to the rotational axis of the plate, an elongated cylindrical object such as a filter-tipped cigarette, and to place, for example in a second channel portion of the drum, such an object or cigarette, after having caused it to rotate through half a revolution from its being taken, the taking up and the putting down being carried out substantially simultaneously.

It is known that filter-tipped cigarettes are produced, in general, by placing a filter tip between two cigarettes, the whole being aligned, for example in a channel of a first drum; the three elements are brought together by a paper strip called a sleeve, rolled up and stuck around the filter tip and the two ends of both cigarettes, then, the whole is cut in the middle of the filter tip. Thus is obtained, on a second drum, two rows of cigarettes facing opposite directions, but it is generally necessary to reverse the cigarettes of one row and line them up with the cigarettes of the other row, so as to obtain finally on a third drum a single row of cigarettes facing the same direction.

A known device for orientating cigarettes, and particularly described in French patent application No. 2,243,657 uses a horizontal plate fitted with reversal members rotating about a vertical axis parallel to the axis of rotation of the plate and simultaneously carrying out the taking up of the cigarettes from, and their placing in, two non aligned channel portions of the second drum. Besides their rotation, the reversal members effect translational movements along their rotational axis to avoid the collision of the cigarettes during reversal.

Apart from the existence of numerous problems of wear, such a design brings into evidence the need for using flexible pipes which are generally very fragile in use.

Furthermore, the design of this device makes it generally indispensable to stop operation altogether as soon as any obstruction occurs. Such a restriction is particularly disadvantageous, not only because operating time of the cigarette orientating device is thus reduced but also because the starting up again of such a device is a delicate operation.

The present invention has as its aim the elimination of these disadvantages by providing a reversing plate whose design ensures excellent characteristics of long operating life and reliability.

SUMMARY OF THE INVENTION

According to the invention, each of the reversal heads carries out, in relation to the plate, no other movement but its rotation, the axis of this rotation forming with the axis of rotation of the plate an angle whose tangent is greater than the ratio of the diameter of the objects or cigarettes to be reversed to the distance separating the axes of rotation of two adjacent reversal heads.

Furthermore, the plate is advantageously sloping in relation to a horizontal direction to permit badly formed cigarettes to fall, thus contributing to avoiding obstruction risks.

BRIEF DESCRIPTION OF THE DRAWING

A particular embodiment of the invention will be described here-after, solely as an indication and in no way limiting with reference to the accompanying drawings in which.

Figure 1:
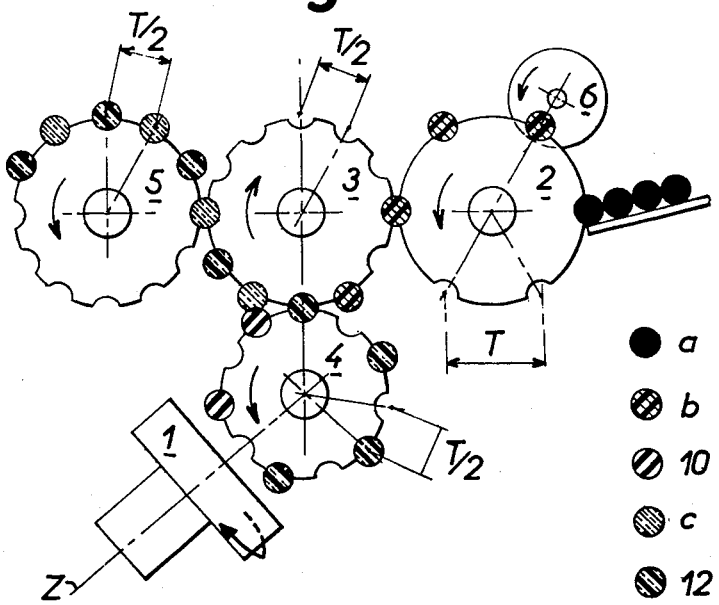
FIG. 1 is a front view of the part of a machine for manufacturing filter tipped cigarettes, comprising the device for orientating the cigarettes.

DESCRIPTION OF THE PREFERRED EMBODIMENT:

Couples a of cigarettes (FIG. 1), formed by two cigarettes separated by a double length filter and brought together by a paper strip called a sleeve, are deposited in any suitable way, one by one, in the successive channels of a cutting drum 2 associated with a circular knife 6 which cuts the double length filter in the middle to give two cigarettes b, facing different directions.

These cigarettes b are transferred from cutting drum 2 to a first intermediate channelled drum 3 which receives two cigarettes b per channel. The pitch T/2 of this intermediate drum 3 is half pitch T of the first drum 2, so that one channel out of two only of drum 3 is filled with cigarettes b.

One of the two cigarettes b, e.g. the rear cigarette c, is transferred directly from drum 3 to a transporter drum 5 whereas the other of these two cigarettes b, e.g. the front cigarette 10, is transferred to a second intermediate drum 4, then to the orientating device 1 of the present invention which reverses the cigarettes 10 to 12 so as to align these cigarettes 12 with cigarettes c, by means of drum 4, on the periphery of drum 3.

Cutting drum 2, intermediate drums 3 and 4 and transporter drum 5 are mounted on parallel and horizontal shafts which are fixed to the frame of the machine and are driven at the same peripheral speed.

The channels serving as housing for the cigarettes are, for each of drums 2, 3, 4 and 5, equidistant and parallel to the axis of the drum, but whereas these peripheral channels present a pitch T for drum 2, they have a pitch T/2 for the other drums 3, 4, 5. Each of the channels is provided with apertures connected to an air suction source so as to maintain the cigarettes in place, in a way known per se.

Intermediate drums 3 and 4 comprise respectively an even number and an uneven number of channels.

The orientating device 1, forming the subject of the invention, cooperates with drum 4. This device is composed essentially (FIG. 5) of a hollow plate 13 whose hollow shaft 14 can rotate in a frame 15 perpendicularly to the rotational axis of drum 4. The elements for driving plate 13 are formed by a pair of bevel gears 16 and 17, gear 16 is splined to hollow shaft 14 and gear 17 is mounted on a drive shaft 18 connected to a mechanism for synchronising with drums 2, 3, 4 and 5, this mechanism not being shown as being known per se.

Hollow plate 13 is fitted with reversal heads 13*a* (one of which is shown in position in FIG. 5), each comprising a support 26 fixed by its base, possibly by means of a part 26*a*, on the internal face of the lower wall of plate 13, and a tip 7 passing through the upper surface of plate 13. Tip 7 of each of heads 13*a* has two recesses 8 and 9 (FIG. 2) provided with apertures 11*a* and 11*b* connected to an air suction source (not shown), so as to take up by suction a cigarette by one of its ends (filter end for example) and to rotate this cigarette through 180° in the opposite direction to the rotation of plate 13, during a complete rotation of this latter.

Figure 5:
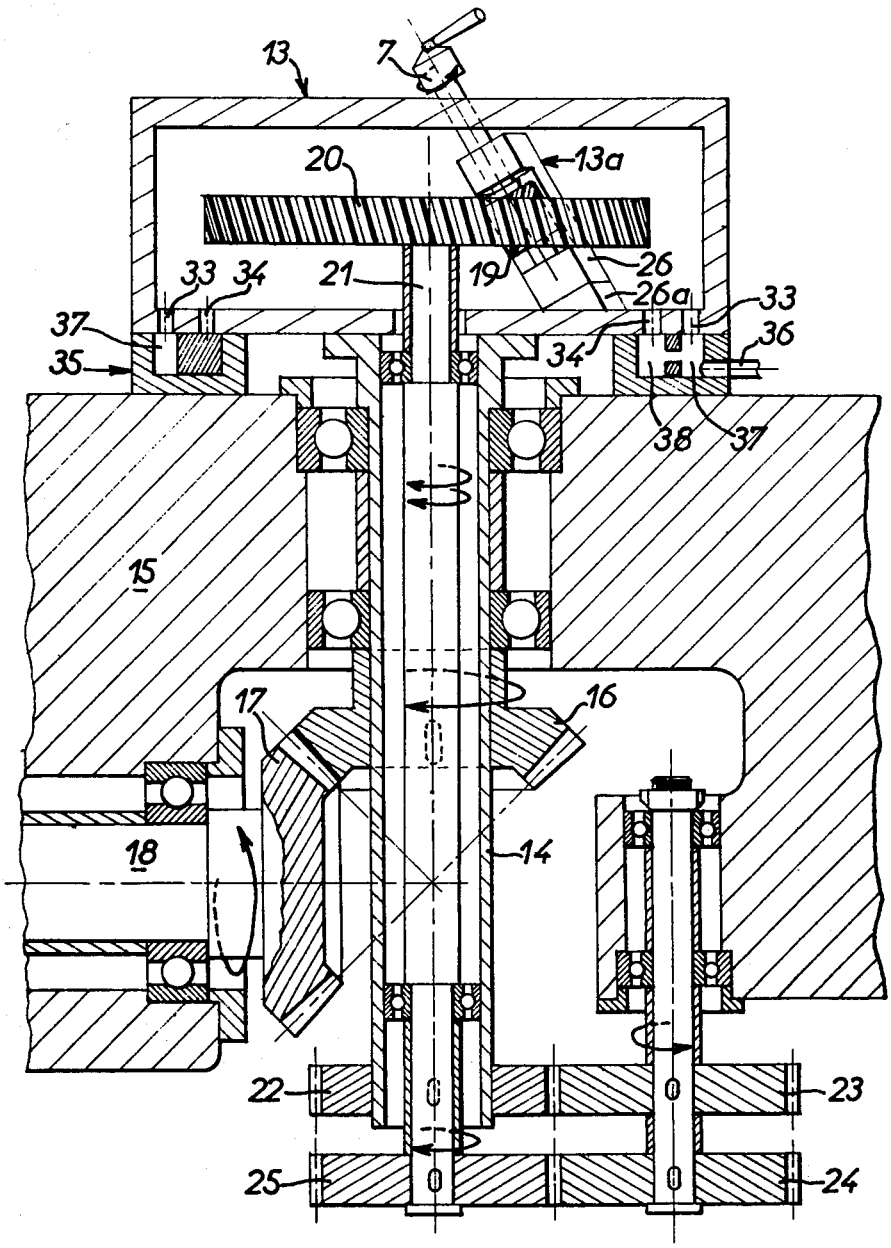
FIG. 5 is a sectional view of the device for orientating cigarettes on which has been shown a reversal head seen end on at the angle shown by arrow V of FIG. 7.
Figure 6:
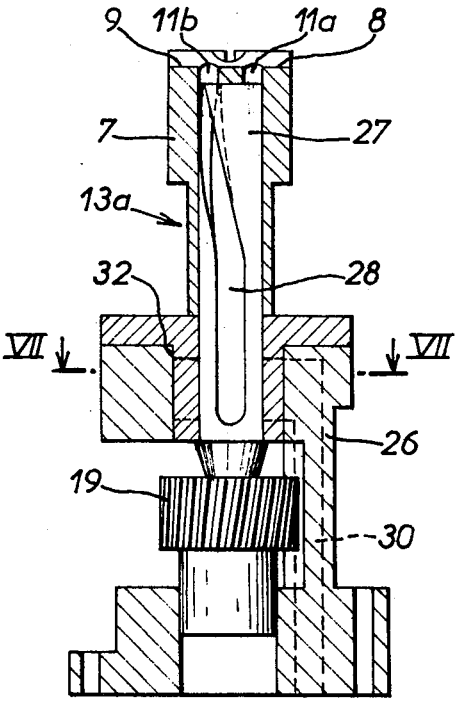
FIG. 6 is a sectional view of a reversal head.

To this end, a shaft 27, mounted in support 26 of each head 13*a* (FIGS. 6 and 7), is integral, on the one hand with tip 7 and, on the other, with a sloping gear 19 which meshes with a crown wheel 20 mounted inside hollow plate 13 (FIG. 5). This crown wheel 20 is splined to a shaft 21 mounted inside hollow shaft 14. Shaft 21 is driven, from shaft 14, through a gear train 22, 23, 24 and 25. The transmission thus obtained is designed, in a manner known per se, so that the rotational speed of the crown wheel 20 is slightly greater than that of plate 13 so that when this plate 13 completes a revolution, tip 7 of each head 13*a* effects a half revolution in the opposite direction.

Figure 2:
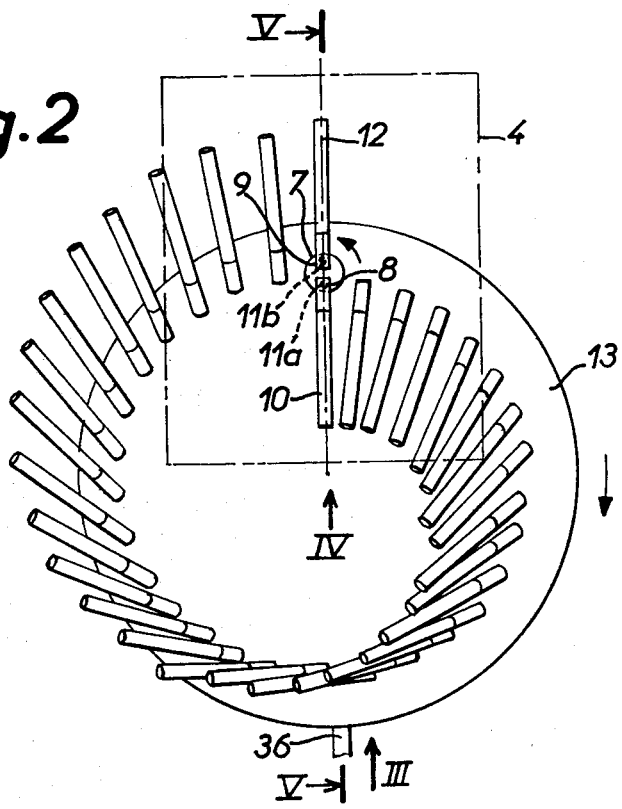
FIG. 2 is a top view of the reversal plate supplied with cigarettes and on which the reversal heads have not been shown, for a better understanding.

With a view to obtaining a slow reversal speed with a plate having a not very large diameter, it is necessary to provide on plate 13 as great a number as possible of heads 13*a* (e.g. 30, or between 20 and 40) which are then separated by a distance less than the length of the cigarettes. There results immediately a problem of collision of cigarettes during reversal, as can be seen in FIG. 2.

Figure 3:
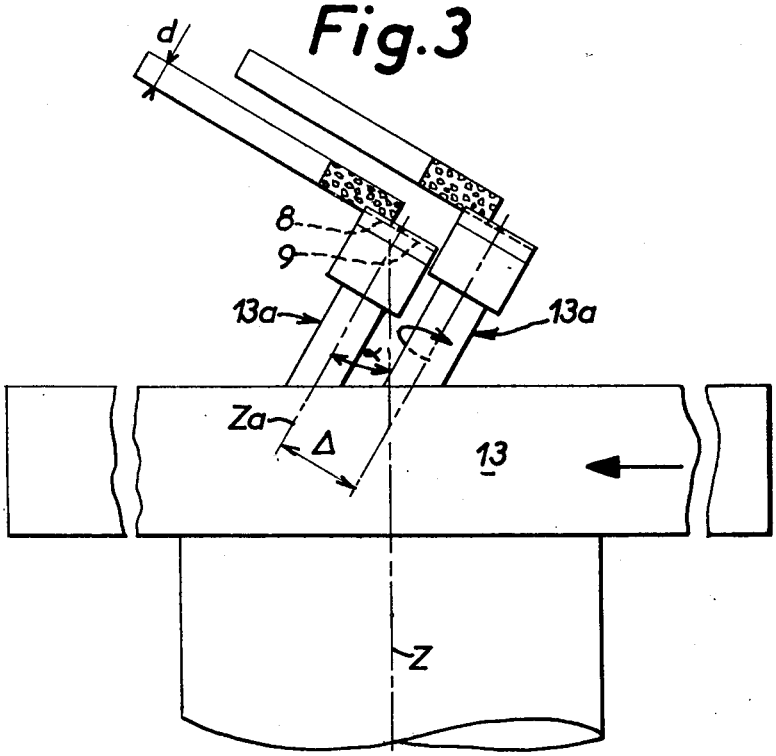
FIG. 3 is an outside side view of the plate fitted with the reversal heads, seen in a direction shown by arrow III of FIG. 2.

According to the invention, this problem is resolved by causing each of heads 13*a* to effect only a movement of rotation, axis Za of this rotation (FIG. 3) forming with axis Z of rotation of plate 13 an angle $\alpha$ whose tangent is greater than the ratio of diameter d of the objects or cigarettes to be reversed to the distance $\Delta$ separating the rotational axis Za of two adjacent reversal heads.

More concisely: $\tan \alpha > d/\Delta$

In a standard construction, an angle $\alpha$ of about 30° should be able to fulfil this condition.

As can be seen in FIG. 1, the rotational axis Z of plate 13 is sloping and forms preferably an angle of at least 45° with the vertical so as to promote the discharge by gravity of the cigarettes in the case of a malfunction.

A possible structure of the suction air distribution elements will be described in more detail in the following paragraphs.

Figure 4:
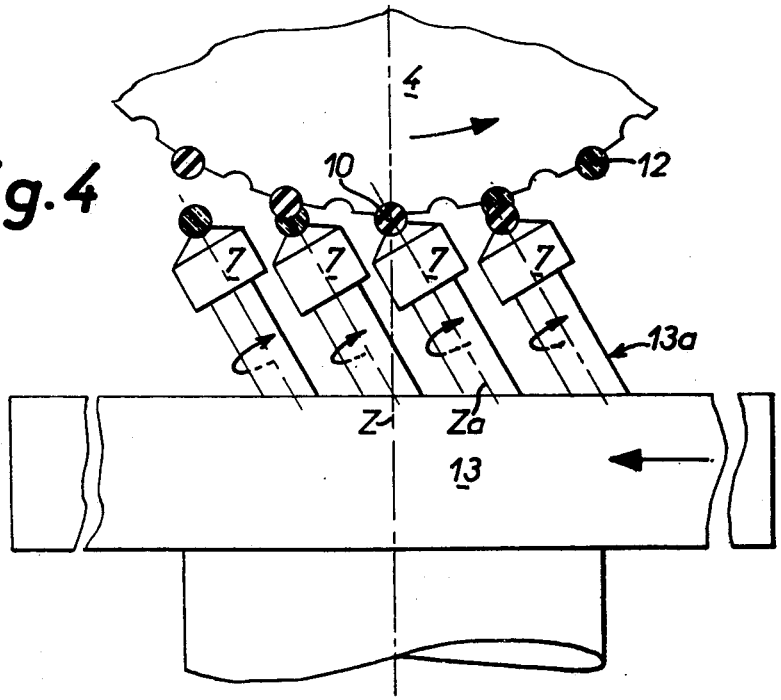
FIG. 4 is another external side view of this plate, seen in a direction following arrow III of FIG. 2 but on which the reversal heads shown belong to the second plate, and are seen in the direction shown by arrow IV of FIG. 2.

If plate 13 of the invention is meant to cooperate as shown, with an intermediate drum 4 having an uneven number of channels, recesses 8 and 9 of each tip 7 are disposed on each side of the rotational axis Za of this tip and aligned. Each time that a recess, 8 for example (FIGS. 2 and 4) of tip 7, takes up by suction a cigarette 10 from a first channel portion AV of drum 4, the other recess 9, of the same tip, facing the opposite direction, releases, in a second portion AR of the same channel of drum 4, a cigarette 12 which has just been reversed.

It is then necessary, from an initial position such as shown in FIG. 2, to create first of all a partial vacuum in aperture 11*a* during a complete revolution of plate 13 then, simultaneously, to remove this partial vacuum so as to allow the reversed cigarette (FIG. 4) to be transferred to the drum and to establish this partial vacuum in aperture 11*b* so as to allow another cigarette to be picked up for reversing, this partial vacuum in aperture 11*b* being maintained during the following complete revolution of plate 13.

To this end, suction air from a suitable outside source (not shown) is brought, by piping 36 (shown in FIGS. 5 and 8 and also in FIG. 2 for a better understanding), into a distributor 35 (FIGS. 5 and 8) fixed in relation to frame 15 and having two semi-circular grooves of different radii 37 and 38 communicating with the piping 36 and the lower wall of plate 13 has pairs of apertures 33 and 34, one pair of apertures for each head 13*a*, opening into grooves 37 and 38 of distributor 35, aligned in a radial direction, and which intermediate part 26*a* of each head puts separately in communication with cylindrical passages 30 and 31 provided in support 26 of this head; in addition, shafts 27 has two longitudinal diametrically opposed slots 28 and 29 which permit the suction air to reach recesses 8 and 9 through apertures 11*a* and 11*b*, the suction air coming from piping 36 being directed into the slot which corresponds to the recess loaded with a cigarette, by a fixed spreader 32.

This fixed spreader 32 has two diametrically opposed walls 32*a* and 32*b* such that one 32*a* is wider than slots 28 and 29 and the other 32*b* is narrower than these slots.

Figure 8:
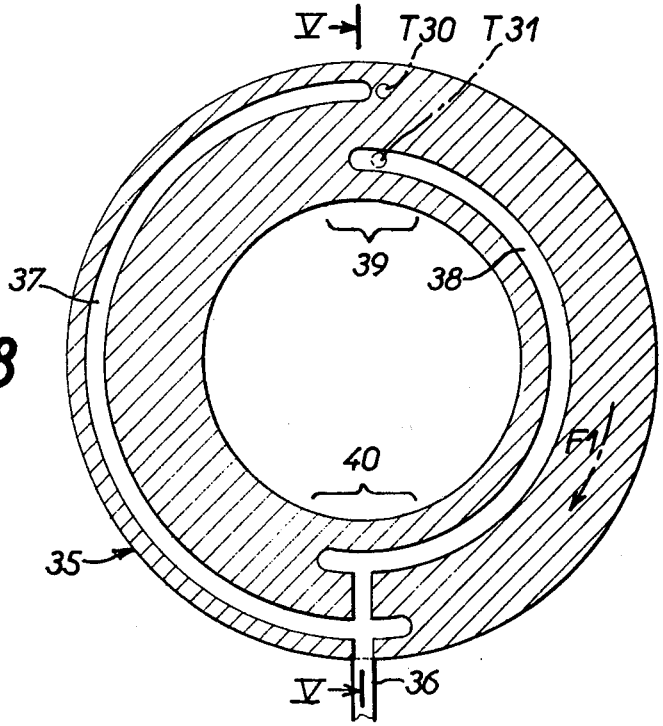
FIG. 8 is a top view of a suction air distributor, line V—V showing the angle at which this distributor is seen in section in FIG. 5.

In FIG. 8 there has been shown a zone 39 corresponding to the transfer zone of cigarettes 10 and 12 (FIG. 2) respectively to and from successive reversal heads. T30 and T31 represent the locations of the apertures of intermediate part 26*a* which communicate respectively with passages 30 and 31 formed in support 26.

Figure 7:
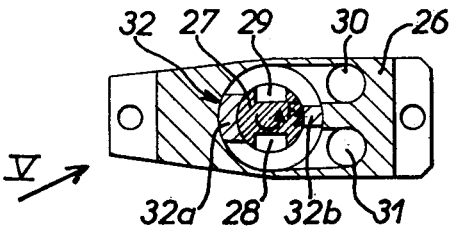
FIG. 7 is a sectional view of a reversal head along line VII—VII of FIG. 6.

When a reversal head is in zone 39 (transfer zone of cigarettes 10 and 12 in FIG. 2), shaft 27 is, in relation to spreader 32, in the position shown in FIG. 7.

Suction air supplied through groove 38 passes through passage 31, slot 28 and reaches recess 8 through aperture 11*a* so that cigarette 10 is sucked on to tip 7. On the other hand, suction air which was supplied before zone 39, by groove 37, to passage 30, to slot 29 and to recess 9 through aperture 11*b* to maintain cigarette 12 on tip 7 has just been cut off, since location T30 has passed groove 37: cigarette 12 is released at the drum and the suction air no longer passes through aperture 11*b*.

After a half revolution of plate 13 in the direction of arrow $F_1$ (FIG. 8), locations T30 and T31 are in "relay" zone 40, shaft 27 has rotated a quarter of a revolution in the direction of arrow F2 (FIG. 7), and slot 28 opens on both sides of the narrow wall 32*b* of spreader 32 whereas slot 29 is blocked by the wide wall 32*a* of this spreader. Therefore, the suction air delivered through grooves 37 and 38 to passages 30 and 31 still reaches then recess 8 through slot 28 and aperture 11*a*. On the other hand, the suction air still does not pass through aperture 11*b* since slot 29 is blocked by wall 32*a*.

After three-quarters of a revolution of plate 13, the suction air is delivered to aperture 11*a* from groove 37 through passage 30 and slot 28 then located in the zone of this passage 30.

As slot 29 then opens into the zone of passage 31, and since location T31 is in a zone deprived of groove 38, suction air still does not pass through aperture 11*b*.

In fact, the suction air will only be delivered to recess 9 through aperture 11*b* and cut off at recess 8 by aperture 11*a* in the transfer zone 39 in which groove 37 disappears to the benefit of groove 38.

A new cigarette is taken up in portion AV of a channel of drum 4 whereas the reversed cigarette is released in portion AR of this channel and the procedure described is repeated.

It is of course to be understood that the above embodiment has been given solely as an example and that modifications may be made by a man skilled in the art without departing from the scope and spirit of the present invention.

What is claimed as new is:

1. A rotatable plate for orienting cylindrical objects such as cigarettes and adapted to cooperate with a drum rotatable about an axis perpendicular to the rotational axis of the plate for taking up said objects from a first channel portion of said drum and placing said objects after orientation in a second channel portion of said drum, said taking up and placing of said objects being carried out substantially simultaneously, said plate comprising reversal heads mounted on said plate, each reversal head comprising a shaft having an integral tip provided with two apertures opening into two recesses, said shaft having two slots and rotatable in a spreader mounted in a support in which two passages are provided for the intake of suction air, means for rotating said plate, and means for rotating said reversal heads such that they effect a half revolution while the plate effects a complete revolution in an opposite direction, each of the reversal heads effecting no other movement but its rotation in relation to said plate and being rotatable about an axis fixed in relation to said plate and forming with the rotational axis of the plate an angle whose tangent is greater than the ratio of the diameter of the objects to be oriented to the distance separating the rotational axes of two adjacent reversal heads.

2. A plate according to claim 1, wherein the two recesses are aligned and disposed on each side of the rotational axis of the reversal head.

3. A plate according to claim 1, wherein the spreader has one wall whose width is at least equal to that of said slots of said shaft and one wall whose width is less than that of said slots.

4. A device for reorientating elongate objects having a maximum transverse dimension, the device comprising:

a body member rotatable about an axis and having an end surface at one axial extremity of the body member, a plurality of reversal heads equispaced about the rotation axis of the body member and each mounted on the body member for rotation about respective axes of rotation, the axes of rotation of the heads each being inclined at a common angle to a direction parallel to the rotation axis of the body member, first rotative drive means arranged to rotate the body member about its rotation axis, second rotative drive means coupled to said first drive means and arranged to rotate each head a half revolution about its respective axis while the body member effects a complete revolution, the body member being rotated in use of the device and the reversal heads operating one by one to accept into the device a continuous supply of elongate objects and to present for removal from the device a continuous supply of said objects whose orientation has been reversed in the device, wherein each reversal head is mounted on the body member so as to project from said end surface of said body member, wherein the product of the spacing apart of the axes of the reversal heads measured perpendicular to said axes and the tangent of said common angle exceeds said maximum transverse dimension of said objects, and wherein, in use of the device, each head, in turn, accepts an object and presents another object at the same time.

5. A device for reorientating elongate objects having a maximum transverse dimension, the device comprising:

a body member rotatable about an axis and having an end surface at one axial extremity of the body member, a plurality of reversal heads equispaced about the rotation axis of the body member and each mounted on the body member for rotation about respective axes of rotation, the axes of rotation of the heads each being inclined at a common angle to a direction parallel to the rotation axis of the body member, first rotative drive means arranged to rotate the body member about its rotation axis, second rotative drive means coupled to said first drive means and arranged to rotate each head a half revolution about its respective axis while the body member effects a complete revolution, the body member being rotated in use of the device and the reversal heads operating one by one to accept into the device a continuous supply of elongate objects and to present for removal from the device a continuous supply of said objects whose orientation has been reversed in the device, wherein each reversal head is mounted on the body member so as to project from said end surface of said body member, wherein the product of the spacing apart of the axes of the reversal heads measured perpendicularly to said axes and the tangent of said common angle exceeds said maximum transverse dimension of said objects, wherein the reversal heads each comprise a shaft having an integral tip provided with two apertures opening in two recesses, said shaft having two slots and being rotatable in a spreader mounted in a support in which two passages are provided for the intake of suction air, and wherein, in use of the device, each head, in turn, accepts an object and presents another object at the same time.

6. A device according to claim 5, wherein the two recesses are aligned and disposed on each side of the rotational axis of the reversal head.

7. A device according to claim 5, wherein the spreader has one wall whose width is at least equal to that of said slots of said shaft and one wall whose width is less than that of said slots.

8. A device for reorientating elongate objects having a maximum transverse dimension, the device comprising:

a body member rotatable about an axis and having an end surface at one axial extremity of the body member, a plurality of reversal heads equispaced about the rotation axis of the body member and each mounted on the body member for rotation about respective axes of rotation, the axes of rotation of the heads each being inclined at a common angle to a direction parallel to the rotation axes of the body member, first rotative drive means arranged to rotate the body member about its rotation axis, second rotative drive means coupled to said first drive means and arranged to rotate each head a half revolution about its respective axis while the body member effects a complete revolution, the body member being rotated in use of the device and the reversal heads operating one by one to accept into the device a continuous supply of elongate objects and to present for removal from the device a continuous supply of said objects whose orientation has been reversed in the device, wherein each reversal head is mounted on the body member so as to project from said end surface of said body member, wherein the product of the spacing apart of the axes of the reversal heads measured perpendicularly to said axes and the tangent of said common angle exceeds said maximum transverse dimension of said objects, wherein, in use of the device, each head, in turn, accepts an object and presents another object at the same time, wherein the reversal heads each comprise a shaft having an integral tip provided with two apertures opening in two recesses, said shaft having two diametrically opposite slots respectively communicating with said two apertures, said shaft being rotatable in a spreader mounted in a support in which first and second passages are provided, said first and second passages being, once each, in a essentially alternative manner, connected to a suction air source in the course of a revolution of the body member, and said two slots each communicating with at least one of said first and second passages at the same time.

9. A device according to claim 8, wherein the spreader has a first wall whose width is at least equal to that of said slots of said shaft and a second wall diametrically opposite of said first wall and whose width is less than that of said slots, and wherein each one of said slots, when facing said second wall, begins to communicate with said first passage and finishes communicating with said second passage, while said first passage begins to be connected to said suction air source.

* * * * *